US012091927B2

(12) United States Patent
Alhashim et al.

(10) Patent No.: US 12,091,927 B2
(45) Date of Patent: Sep. 17, 2024

(54) WELLHEAD IMPRESSION TOOL FOR EVALUATING CONDITION OF WELLHEAD SPOOLS

(71) Applicant: SAUDI ARABIAN OIL COMPANY, Dhahran (SA)

(72) Inventors: Abdulrhman Mohammed Alhashim, Dammam (SA); Mohammad Saeed Alsaeed, Dhahran (SA); Mohammed Eid Almukhlifi, Dammam (SA); Mansour Abdullah Alamer, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/055,686

(22) Filed: Nov. 15, 2022

(65) Prior Publication Data

US 2024/0159120 A1 May 16, 2024

(51) Int. Cl.

| | |
|---|---|
| ***E21B 47/098*** | (2012.01) |
| ***E21B 33/038*** | (2006.01) |
| ***E21B 33/04*** | (2006.01) |
| ***E21B 33/12*** | (2006.01) |

(52) U.S. Cl.

CPC ..... *E21B 33/04* (2013.01); *E21B 33/038* (2013.01); *E21B 33/1208* (2013.01); *E21B 47/098* (2020.05)

(58) Field of Classification Search

CPC ..... E21B 47/098

See application file for complete search history.

(56) References Cited

U.S. PATENT DOCUMENTS

| | | | | |
|---|---|---|---|---|
| 3,855,856 | A * | 12/1974 | Hutchison | E21B 47/098 73/152.57 |
| 3,905,227 | A * | 9/1975 | Kinley | E21B 47/098 73/152.57 |
| 3,960,212 | A * | 6/1976 | Hutchison | E21B 47/098 166/187 |
| 4,659,530 | A * | 4/1987 | Boyers | E21B 47/098 264/315 |
| 4,770,248 | A * | 9/1988 | Houlgrave | H01R 13/523 166/341 |
| 5,044,438 | A | 9/1991 | Young | |
| 8,403,056 | B2 | 3/2013 | Gette et al. | |
| 11,125,042 | B1 | 9/2021 | Mukhlifi | |
| 2021/0404282 | A1 * | 12/2021 | McAllister | E21B 17/1007 |

FOREIGN PATENT DOCUMENTS

| | | | | |
|---|---|---|---|---|
| BR | PI1103531 A2 | 12/2012 | | |
| GB | 2014213 A * | 8/1979 | | E21B 33/1208 |

* cited by examiner

*Primary Examiner* — Giovanna Wright

(74) *Attorney, Agent, or Firm* — Vorys, Sater, Seymour and Pease, LLP

(57) ABSTRACT

A wellhead impression tool includes an elongate central body having opposing upper and lower ends, and defining an inner chamber, an impression sleeve arranged concentric with the central body and made of a malleable material, and a hydraulic assembly extending between the impression sleeve and the central body and in fluid communication with the inner chamber to receive a hydraulic fluid from the inner chamber. The hydraulic assembly is operable to force the impression sleeve radially outward and into engagement with a bowl of a wellhead spool of a wellhead assembly, and forcing the impression sleeve against the bowl results in a physical impression of the bowl on an outer surface of the impression sleeve.

16 Claims, 4 Drawing Sheets

WELLHEAD IMPRESSION TOOL FOR EVALUATING CONDITION OF WELLHEAD SPOOLS

FIELD OF THE DISCLOSURE

The present disclosure relates generally to wellheads in the oil and gas industry and, more particularly, to a wellhead impression tool configured to evaluate damage to the interior of wellhead spools, such as a tubing head spool, a casing head housing, or a casing head spool, which form part of a wellhead.

BACKGROUND OF THE DISCLOSURE

In the oil and gas industry, a wellhead assembly or "wellhead" is typically attached at the uphole end of a wellbore penetrating a hydrocarbon producing formation. A production tree (or "Christmas tree") usually connects to the upper end of the wellhead for controlling flow in and out of the wellbore and allowing access into the wellbore. Support hangers are included within the wellhead for suspending production tubing and casing into the wellbore. The casing lines the wellbore, thereby isolating the wellbore from the surrounding formation, and the production tubing lies concentric within the casing and provides a conduit for producing the hydrocarbons entrained within the formation.

The wellhead is commonly made up of a variety of wellhead spools, such as a tubing head spool, which supports a tubing hanger and production tubing extended into the wellbore. Other common wellhead spools include casing head housings and casing head spools. At least a portion of the interior of the wellhead spools is referred to as a "bowl," and if there is any damage to the bowl area, the wellhead will oftentimes be unable to pressurize. In such cases, a rig assembly may need to be erected to disassemble the wellhead and return any completion strings deployed downhole. Once disassembled, the source of the pressure leak might be determined, and the wellhead may then be reconstructed to re-deploy the completion string into the wellbore.

Since this well workover operation is expensive and time-consuming, it is desirable to have a means or system configured to determine damage to the wellhead spools without having to entirely deconstruct the wellhead and completion strings.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellhead impression tool includes an elongate central body having opposing upper and lower ends, and defining an inner chamber, an impression sleeve arranged concentric with the central body and made of a malleable material, and a hydraulic assembly extending between the impression sleeve and the central body and in fluid communication with the inner chamber to receive a hydraulic fluid from the inner chamber. The hydraulic assembly is operable to force the impression sleeve radially outward and into engagement with a bowl of a wellhead spool of a wellhead assembly, and forcing the impression sleeve against the bowl results in a physical impression of the bowl on an outer surface of the impression sleeve.

According to another embodiment consistent with the present disclosure, a method of operating a wellhead impression tool can include advancing the wellhead impression tool into a through bore of a wellhead spool of a wellhead assembly, the through bore defining a bowl and the wellhead impression tool including an elongate central body having opposing upper and lower ends, and defining an inner chamber, an impression sleeve arranged concentric with the central body and made of a malleable material, and a hydraulic assembly extending between the impression sleeve and the central body and in fluid communication with the inner chamber. The method may further include conveying a hydraulic fluid to the hydraulic assembly from the inner chamber, forcing the impression sleeve radially outward with the hydraulic assembly and into engagement with the bowl, and obtaining a physical impression of the bowl on an outer surface of the impression sleeve.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
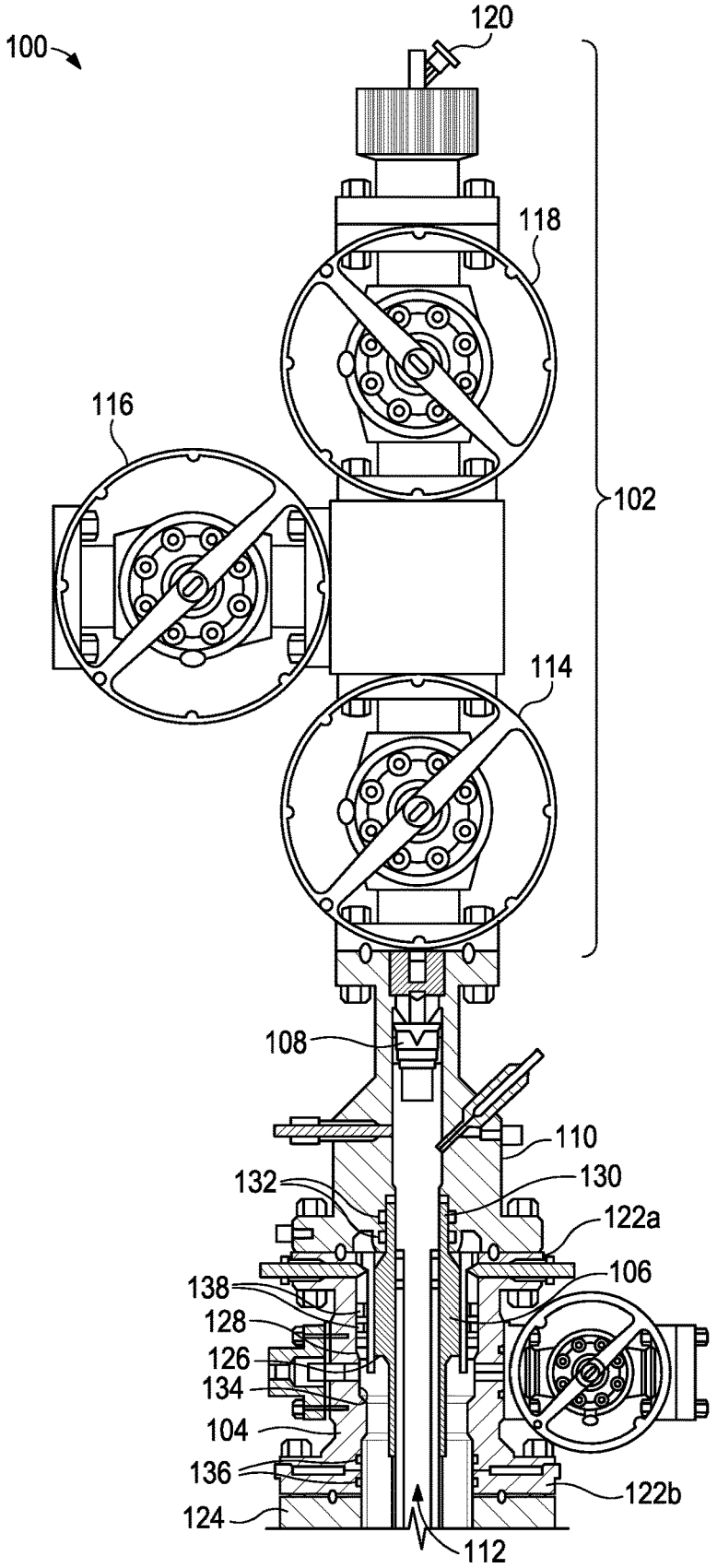
FIG. 1 is a schematic diagram of an example wellhead assembly that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments disclosed herein describe a wellhead impression tool that can be used to evaluate the condition of the bowl of a tubing head spool of a wellhead before removing a blowout preventer (BOP) from the well during a workover operation. As described herein, the impression tool includes a central body, an impression sleeve, one or more hydraulic assemblies, and one or more cameras. To use the impression tool, a rig at a well site may retrieve the existing tubing hanger and completion from the wellbore, and subsequently wash the bowl of the existing tubing head spool with a wash tool. The rig can then run the impression tool in a retracted state to the required depth at the bowl area of the tubing head spool. The cameras attached to the impression tool can be used to monitor the bowl area and capture images and/or video of any damage. Once the impression tool is at the proper depth within the bowl area, the rig will pump water through the central body of the impression tool to hydraulically expand the impression sleeve, which is forced into physical contact with the bowl area. The impression sleeve may be made out of a malleable material, thus forcing it into contact with the bowl area will result in a physical impression being made on the outer surface of the impression sleeve, which captures any damage (e.g., scratches, scores, etc.) without damaging the wellhead. The hydraulic pressure is then reduced, which retracts the sleeve and allows the impression tool to be reversed out of the tubing head spool so that a well operator can evaluate the marks created on the outer surface of the impression tool.

Conventional methods used in drilling and workover operations have a main disadvantage. If a new tubing hanger is installed, it can only be tested until the BOP is removed and the tubing head adapter is installed. If the hanger leaks, this will result in a costly operation since the completion must be retrieved. After that, the well must be secured by barriers (e.g., mechanical plugs or cement plugs) in order to remove the BOP. Once the BOP is removed, then the tubing spool bowl can be inspected. At that stage, the well may need additional barriers to remove the tubing spool and install a new one. After that, a new completion string will be run downhole and a new tubing hanger will be installed.

The wellhead impression tool described herein minimizes such risks, especially in workover operations. If significant marks are captured on the outer surface of the impression sleeve and verified by the cameras, then the well operator will not run a new completion and will instead proceed to securing the well to remove, repair, and/or replace the existing tubing head spool.

FIG. 1 is a schematic diagram of an example wellhead assembly 100 that may incorporate the principles of the present disclosure. As illustrated, the wellhead assembly 100 (hereafter the "wellhead 100") includes a production tree 102 (alternately referred to as a "Christmas" tree), a tubing head spool 104, a tubing hanger 106, a back pressure valve 108, and a tubing head adapter 110. These components of the wellhead 100 are installed in stages during the drilling phase of a well. The tubing head spool 104, the tubing hanger 106, and the tubing head adapter 110 play a major role in the well production and integrity.

The wellhead 100 serves several functions, such as providing sealed connections and support for each tubular string (e.g., casing, production tubing, etc.) extended into a wellbore. The wellhead 100 also provides a connection and support for production equipment, such as the production tree 102 and the tubing head adapter 110. The wellhead 100 also provides the necessary connections and support for well control equipment, and further facilitates well production, injection, and future well interventions. The wellhead 100 may be used in either land-based or offshore operations.

The production tree 102 comprises at least one fluid control valve operable to direct fluid along a longitudinal axial bore 112 of the wellhead 100 from tubing (e.g., production tubing) supported by the tubing head spool 104 and the tubing hanger 106, and through the tubing head adapter 110 and the back pressure valve 108. As illustrated, the production tree 102 may include one or more master valves 114 (one shown), one or more right and left hand valves 116 (one shown), and a top valve 118, each of which may be manually or hydraulically operated. The right and left hand valves 116 may regulate the flow of produced hydrocarbons to a storage container or production facility, and may further provide a flow path for injection fluids into the wellhead 100 or formation for treatment or well-control purposes. The top valve 118 may provide a path for well interventions. The production tree 102 may further include a top cap and pressure gauge 120 used to seal the longitudinal axial bore 112 of the wellhead 100 and provide real-time pressure readings.

The tubing head spool 104 receives and supports the tubing hanger 106, and is secured to the production tree 102 via the tubing head adapter 110. As illustrated, the tubing head spool 104 may include an upper flange 122*a* and a lower flange 122*b*. The upper flange 122*a* may secure the tubing head spool 104 to the bottom of the tubing head adapter 110, and the lower flange 122*b* may secure the tubing head spool 104 to the top of a casing spool 124 (partially shown).

The tubing hanger 106 may secure a topmost joint of a tubing string within the wellbore. More specifically, the tubing hanger 106 consists of a cylindrical mandrel with a bottom thread (not shown) that can be threaded to a downhole-extending tubing string, such as production tubing. The tubing hanger 106 also defines a tapered load shoulder 126 designed to engage and sit on a matching load shoulder 128 defined on the inner radial surface of the tubing head spool 104. Once the tubing hanger 106 is properly mated with the tubing head spool 104, the entire weight of the tubing string will be suspended from the shoulder 128 provided by the tubing head spool 104.

The top part of the tubing hanger 106 provides an extended neck 130 that is threadably engageable with a running tool (not shown) used to install and retrieve the tubing hanger 106. The extended neck 130 is considered a sealing area where one or more seals 132 of the tubing head adapter 110 are able to generate a sealed interface. The seals 132 may comprise elastomer or metal seals that generate the sealed interface.

The back pressure valve 108 may comprise a type of check valve designed to hold pressure from one side of the valve, yet enable fluids to be pumped from the other side of the valve. The back pressure valve 108 may maintain well integrity when the production tree 102 is removed.

The inner area and inner radial surfaces of the tubing head spool 104 are often referred to as the "bowl" 134, which is considered a sealing area that must not be damaged. More specifically, portions of the bowl 134 of the tubing head spool 104 may be configured to seal pressure between a wellbore casing and a tubing annulus. For example, the tubing head spool 104 may include one or more first seals 136 configured to seal about a production tubing stub or around a previous hanger neck. The tubing head spool 104 may further include one or more second seals 138 configured to provide a sealed interface between the tubing hanger 106 and the tubing head spool 104 (e.g., the bowl 134). Similar to the seals 132, the seals 136, 138 may comprise elastomer or metal seals that generate a sealed interface.

The seals 136, 138 may be configured to seal the annulus defined between production tubing and casing extended within the wellbore, referred to herein as the tubing casing annulus or "TCA". The pressure within the TCA should be zero psi, which means that all the seals in the tubing hanger 106 and in the downhole completion are sealing and operating properly. It also confirms that there is no leak in the production tubing string itself. If the pressure in the TCA builds, however, this may be an indication that there is a leak in the wellhead 100.

Pressure within the TCA is a common problem in the oil and gas industry, and it can lead to serious consequences if left unrectified, such as lowering the production rate of the well. Also, each tubular string has a maximum collapse and burst pressure that it can withstand. If the pressure in the TCA exceeds the maximum collapse pressure, this could lead to tubing collapse or bursting of the production casing, which is considered a catastrophic failure in the industry. Moreover, the inner part of the production casing will be exposed to the TCA pressure, and this might lead to corrosion and failure of the pipe, and this might lead to another problem in wells, referred to as casing-casing annulus pressure or "CCA" pressure. CCA pressure could result in formation cross-flow, where a water bearing formation begins to flow into the well. The formation water is usually corrosive, which can create more failures at the casing string. Also, the water could flow from one formation and enter another formation due to the change in pressure, which is also considered a serious failure in the industry.

TCA and CCA leaks are costly to fix since they usually require a rig on site. For instance, if TCA pressure is identified in the wellhead 100 due to a leak in the seals 136, 138, a rig is commonly deployed to the well site to secure the well and remove the upper part of the wellhead 100 and thereby gain access to the well. Next, a blow-out preventer (BOP) is installed, and any downhole completions from within the wellbore are retrieved to surface. The tubing hanger 106 and the tubing string are then removed, following which a new completion with packers and tubing string are deployed downhole. The tubing string will be connected to a new tubing hanger 106 which will assume the tubing string weight and land inside the tubing head spool 104 at the shoulder 128. The back-pressure valve 108 will then be assembled within the tubing hanger 106, and the BOP is removed to install the tubing head adapter 104.

At this stage, the seals 136, 138 may be tested by applying pressure in the void between the tubing head adapter 110 and the tubing hanger seals 132. If the test is successful, then the production tree 102 may be reassembled on the tubing head adapter 110 and the workover operation is then complete. However, if the pressure test fails, then all the preceding steps taken must be reversed and the tubing hanger 106 must be retrieved and inspected to determine the cause of the failure.

In some cases, the cause of the failure is not related to the tubing hanger 106, rather it is related to damage to the bowl 134 of the tubing head spool 104. If the bowl 134 (including the load shoulder 128) is damaged or scratched, for example, then the tubing hanger 106 will leak following installation, which will compromise the integrity of the well. This is seen more often in gas wells since the tubing hanger 106 commonly utilizes a metal seal, which will deform and seal the annulus between the tubing hanger 106 and the bowl 134 of the tubing head spool 104. Even a small scratch in the bowl 134 could lead to a leak during the pressure test. In other instances, the tubing hanger 106 might pass the pressure test following installation, but once the well is put on production, a scratch or imperfection in the bowl 134 will propagate and lead to a leak and TCA pressure in the well in a very short time. In such a scenario, the rig will be used again to workover the well a second time in an attempt to fix the issue.

According to embodiments of the present disclosure, a wellhead impression tool may be used to mitigate or eliminate the aforementioned risks and disadvantages. As described herein, the wellhead impression tool may be generally cylindrical in shape and introduced into the interior of the tubing head spool 104 to assess any damage that might be present on the bowl 134. The wellhead impression tool includes an impression sleeve made of a malleable (low yield strength) material, and the impression sleeve may be forced radially outward and into forced engagement with the inner surface of the bowl 134 to obtain an impression of the bowl 134. Upon removal, the impression sleeve may help a well operator identify any damage to the bowl 134. This may prove advantageous in providing the well operator with an opportunity to repair the tubing head spool 104 prior to running the tubing hanger 130. As further described herein, the wellhead impression tool may also include multiple cameras that help visually evaluate the condition (damage) of the bowl 134, thus providing a well operator with high definition images or live video of any damage.

Figure 2:
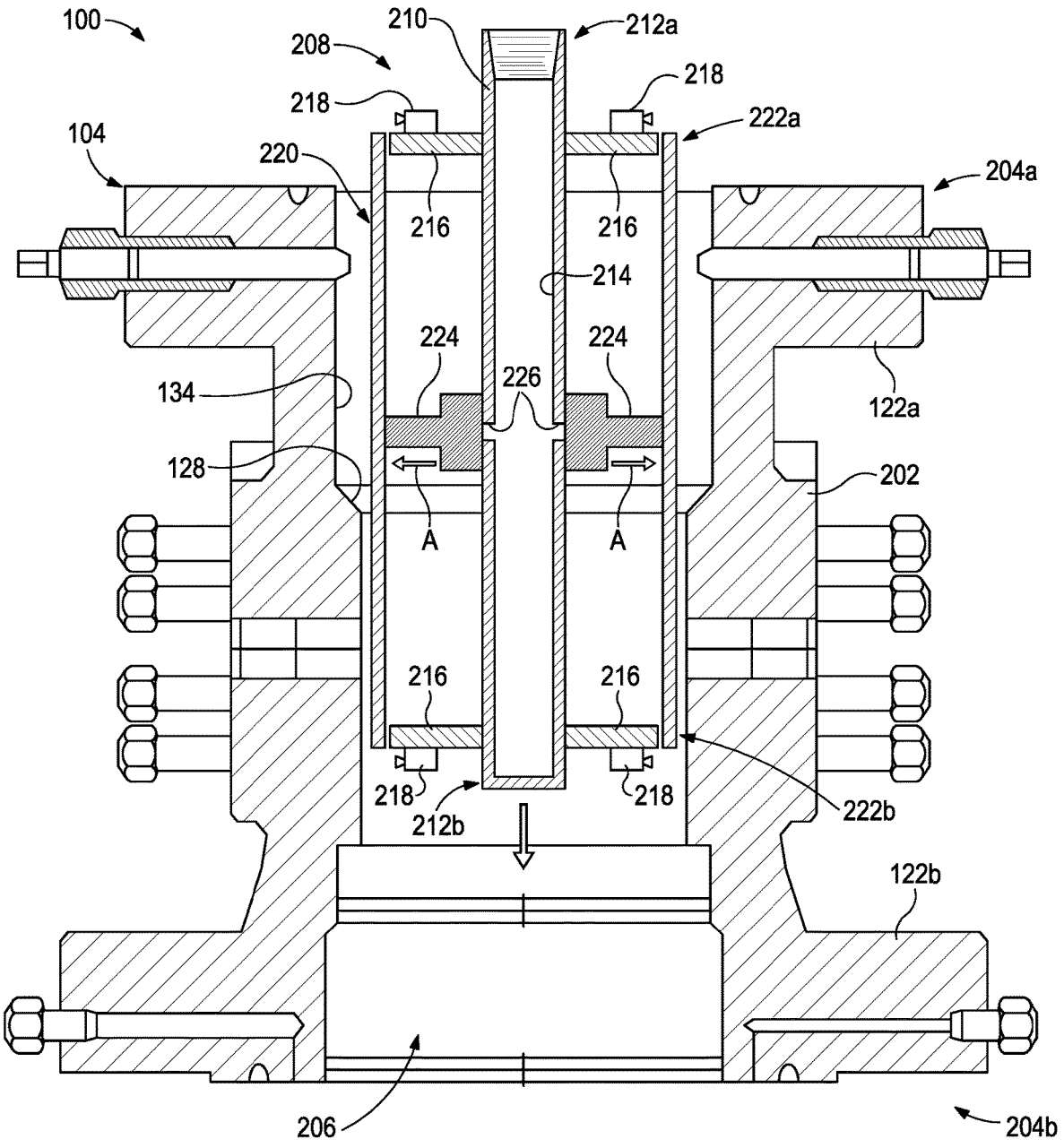
FIG. 2 is an enlarged cross-sectional side view of an example tubing head spool, according to one or more embodiments.

FIG. 2 is an enlarged cross-sectional side view of a portion of the wellhead 100, according to one or more embodiments. More specifically, FIG. 2 depicts an enlarged cross-sectional side view of one example of the tubing head spool 104. While the tubing head spool 104 is shown in FIG. 2 with particular features and elements, those skilled in the art will readily appreciate that the principles of the present disclosure may be equally applicable to other designs and configurations of the tubing at spool 104, without departing from the scope of the disclosure.

As illustrated, the tubing head spool 104 includes or provides a generally cylindrical body 202 having a first or "upper" end 204*a*, a second or "lower" end 204*b*, and a through bore 206 that extends between the upper and lower ends 204*a,b*. The upper flange 122*a* is provided at the upper end 204*a*, and the lower flange 122*b* is provided at the lower end 204*b*. The bowl 134 may be defined within the through bore 206 and may generally comprise all or a portion of the inner radial surfaces of the through bore 206, including the load shoulder 128, which is configured to receive and mate with the tapered load shoulder 126 (FIG. 1) of the tubing hanger 106 (FIG. 1), as described above.

FIG. 2 also depicts a cross-sectional side view of an example wellhead impression tool 208 in accordance with the principles of the present disclosure. While the following description and discussion is directed primarily to using the wellhead impression tool 208 in conjunction with the tubing head spool 104, the principles of the present disclosure are equally applicable to using the wellhead impression tool 208 with other types or designs of wellhead spools generally that may form part of the wellhead 100 (FIG. 1). For example, the wellhead impression tool 208 may alternatively (or in addition) be used in conjunction with the casing head spool 124 (FIG. 1) or a casing head housing (not shown). Consequently, it is contemplated herein to use the wellhead impression tool 208 in conjunction with any type of wellhead spool, without departing from the scope of the disclosure.

As illustrated, the wellhead impression tool 208 (hereafter "the tool 208") provides an elongate central body 210 having a first or "upper" end 212*a* and a second or "lower" end 212*b* opposite the upper end 212*a*. In some embodiments, the central body 210 may comprise a length of pipe; e.g., production tubing, drill pipe, etc. The central body 210 may define or otherwise provide an inner chamber 214 that extends at least partially between the upper and lower ends 212*a,b*. In the illustrated embodiment, the inner chamber 214 extends to the lower end 212*b*, but in other embodiments the inner chamber 214 need not extend all the way to the lower end 212*b*. As described in more detail below, the inner chamber 214 may be configured to receive a hydraulic fluid used to actuate the tool 208.

The upper end 212*a* of the central body 210 may be open, and the lower end 212*b* may be closed or capped. In some embodiments, as illustrated, the upper end 212*a* of the central body 210 may be threaded to enable the tool 208 to be operatively (threadably) coupled to a conveyance, such as a running tool or drill pipe, capable of introducing the tool 208 into the tubing head spool 104 via the upper end 204*a*. In such embodiments, the conveyance may also be configured to convey the hydraulic fluid into the inner chamber 214.

In one or more embodiments, the tool 208 may include one or more beams 216 coupled to and extending laterally (radially outward) from the central body 210. In the illustrated embodiment, the tool 208 includes two beams 216 extending radially outward from the central body 210 at or near the upper end 212*a*, and two beams 216 extending radially outward from the central body 210 at or near the lower end 212*b*. In some embodiments, at least one camera 218 may be coupled to each beam 216. The cameras 218 may be configured to capture images and/or video of the condition of the bowl 134 as the tool 208 advances into the through bore 206 of the tubing head spool 104. Advantageously, the cameras 218 may be generally arranged at or near the upper and lower ends 212*a,b* of the central body 210, which allows the cameras 218 to obtain a broad range of unobstructed images and/or video of the bowl 134 during operation.

The cameras 218 may comprise, for example, high definition cameras capable of capturing high definition images and/or video. In some embodiments, the cameras 218 may be powered by a centralized power source, such as one or more batteries, fuel cells, etc. In other embodiments however, the cameras 218 may receive electrical power via a wired interface or the like. Moreover, the cameras 218 may be in communication with one or more displays or graphical user interfaces (GUIs) operated by a well operator. Accordingly, as the cameras 218 capture live images and/or video, a well operator may receive the captured data in real time. In other embodiments, however, the cameras may be in communication with a storage database or type of memory, and may be configured to transmit capture data to the storage database, which can be accessed at a later time by the well operator upon removal of the tool 208.

The tool 208 may further include an impression sleeve 220, which may be made of a malleable or deformable material, such as a soft metal. In at least one embodiment, the impression sleeve 220 may be made of lead, but could alternatively be made of other low-yield strength metals. The impression sleeve 220 has a first or "upper" end 222*a* and a second or "lower" end 222*b* opposite the upper end 222*a*. The impression sleeve 220 may or may not be operatively coupled to the central body 210 at one or both of its upper and lower ends. In at least one embodiment, however, the impression sleeve 220 may be operatively coupled to the central body 210 at one or both of the upper and lower ends 222*a,b* for support. In such embodiments, one or more of the beams 216 may extend laterally and otherwise radially between the central body 210 and the impression sleeve 220, thus operatively connecting the impression sleeve 220 to the central body 210 and suspending the impression sleeve 220 on the tool 208. In some embodiments, the beams 216 may be arranged substantially at the upper and lower ends 222*a,b* of the impression sleeve 220, such that the cameras 218 are able to obtain unobstructed images and/or video of the bowl 134 above and below the impression sleeve 220 as the tool 208 is introduced into the through bore 206.

In other embodiments, however, the impression sleeve 220 may be disconnected from the beams 216 and instead supported (suspended) on the tool 208 using one or more hydraulic assemblies 224 extending between the central body 210 and the impression sleeve 220. While two hydraulic assemblies 224 are shown in FIG. 2, it will be appreciated that more than two hydraulic assemblies 224 may be provided, without departing from the scope of the disclosure. The central body 210 may define one or more ports 226 capable of conveying hydraulic fluid from the inner chamber 214 to the hydraulic assemblies 224 to operate the hydraulic assemblies 224.

Briefly, each hydraulic assembly 224 may be operable to place a corresponding radially outward load on the impression sleeve 220, in the direction A, which forces the impression sleeve 220 into radial contact with the inner (radial) surfaces of the bowl 134, including the load shoulder 128. Because the impression sleeve 220 is made of a malleable material that exhibits low yield strength, forcing the impression sleeve 220 against the inner surfaces of the bowl 134 creates an impression on the outer surfaces of the impression sleeve 220 at locations where any imperfections or damage may be present on the bowl 134.

Figure 3:
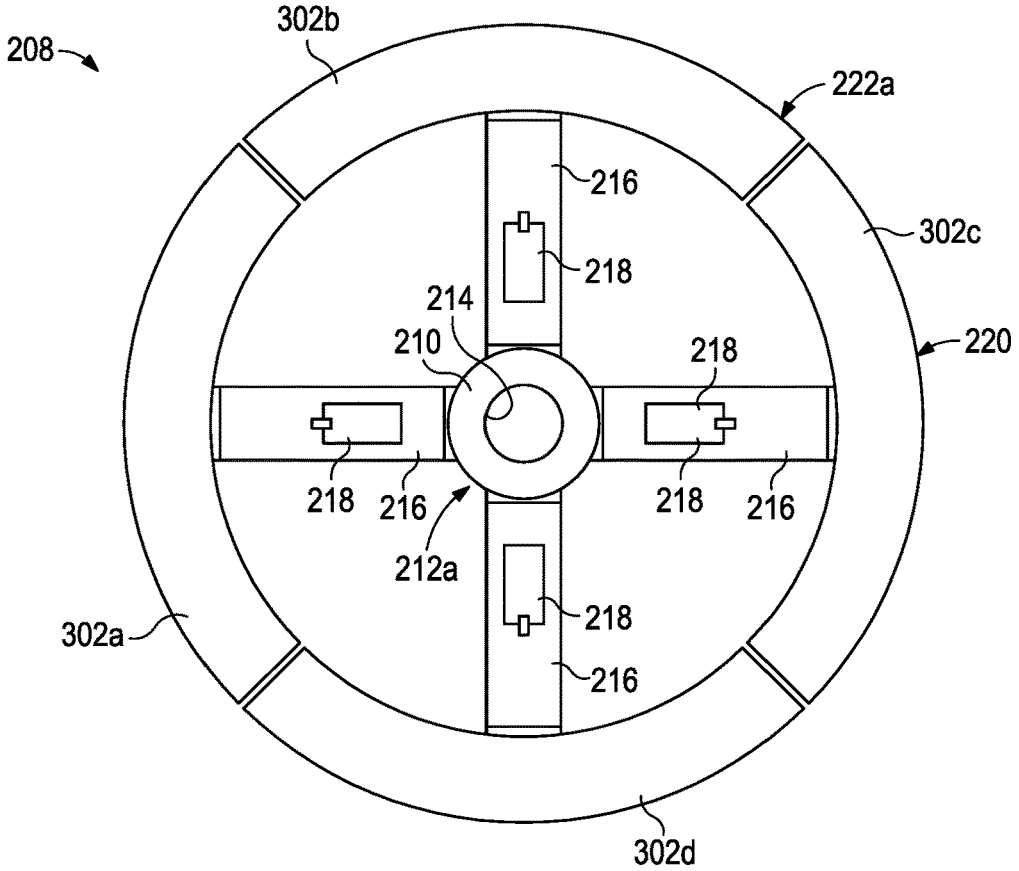
FIG. 3 is a schematic top view of the wellhead impression tool of FIG. 2, according to one or more embodiments.

FIG. 3 is a schematic top view of the tool 208, according to one or more embodiments. More specifically, FIG. 3 provides a view of the upper end 212*a* of the central body 210 and the upper end 222*a* of the impression sleeve 220. In some embodiments, the lower end 212*b* (FIG. 2) of the body 210 and the lower end 222*b* of the impression sleeve 220 may be substantially similar except for the open end of the central body 210 where a threaded tubular may be received into the inner chamber 214.

In the illustrated embodiment, the impression sleeve 220 comprises a cylindrical, circular structure concentric with the central body 210. In some embodiments, the impression sleeve 220 may comprise an annular structure that is monolithic and continuous. In other embodiments however, the impression sleeve 220 may comprise a plurality of arcuate or curved sleeve segments that cooperatively form (make up) the impression sleeve 220. In the depicted embodiment, for example, the impression sleeve 220 comprises a first sleeve segment 302*a*, a second sleeve segment 302*b*, a third sleeve segment 302*c*, and a fourth sleeve segment 302*d*. The sleeve segments 302*a-d* are radially aligned about a common diameter to cooperatively define the outer circumference of the impression sleeve 220.

Each sleeve segment 302*a-d* may be independently operable using a corresponding one of the plurality of hydraulic assemblies 224 (FIG. 2). Accordingly, the number of sleeve segments 302*a-d* will generally dictate the corresponding number of hydraulic assemblies 224. As briefly mentioned above, upon actuation of the hydraulic assemblies 224, the impression sleeve 220 will be forced radially outward to fill the area of the bowl 134 (FIG. 2) and thereby obtain a physical impression of the bowl 134 on the outer surface of the impression sleeve 220. This may result in identification of damage to the bowl 134 revealed in the physical impression obtained on the impression sleeve 220.

Providing the impression sleeve 220 in multiple sleeve segments 302*a-d* of known arcuate lengths may prove advantageous in helping a well operator positively identify the exact location of damage within the bowl 134 (FIG. 2)

following actuation. Moreover, having the impression sleeve 220 formed of multiple sleeve segments 302*a-d* may also prove advantageous in allowing the impression sleeve 220 to radially expand without tearing the material of the impression sleeve 220 and otherwise plastically deforming the circumferential dimensions of the impression sleeve 220, which could prevent the impression sleeve 220 from being extracted (removed) from the tubing head spool 104 (FIG. 2) after use. An additional benefit to providing the impression sleeve 220 in segments is that the impression sleeve 220 can be radially contracted to less than the minimum diameter of the bowl 134, which facilitates easier entry into the bowl 134.

While the impression sleeve 220 is depicted as having four arcuate sleeve segments 302*a-d*, it is contemplated herein to have more or less than four sleeve segments that cooperatively define the impression sleeve 220. Moreover, while the sleeve segments 302*a-d* are depicted in FIG. 3 as generally exhibiting the same size (i.e., thickness) and arcuate length, it is further contemplated herein to have at least one sleeve segment that exhibits a dissimilar size or arcuate length than one or more of the remaining sleeve segments, without departing from the scope of the disclosure.

As illustrated, the beams 216 extend between the central body 210 and the corresponding sleeve segments 302*a-d*. Each beam 216 is operatively coupled to the outer circumference of the central body 210 and extends radially outward therefrom. The beams 216 may be connected to the central body 210 using any known means of fastening or coupling; e.g., mechanical fasteners, mechanical interconnection, welding, brazing, or any combination thereof. In some embodiments, as mentioned above, the impression sleeve 220 may be supported by the beams 216. In such embodiments, each sleeve segment 302*a-d* may be independently supported by a corresponding one of the plurality of beams 216. In other embodiments, however the impression sleeve 220 may not be supported by the beams 216, but is instead solely supported by the hydraulic assemblies 224 (FIG. 2).

In the illustrated embodiment, the beams 116 are equidistantly spaced about the outer circumference of the central body 210, but could alternatively be non-equidistantly spaced, without departing from the scope of the disclosure. The cameras 218 are mounted to the beams 216 and, more particularly, at least one camera 218 may be mounted to each beam 216. In embodiments with four beams 116, as shown in FIG. 3, the cameras 218 may be configured to capture images and/or video of about 90° of the bowl 134 (FIG. 2) as the tool 208 is advanced into and out of the tubing head spool 104 (FIGS. 1 and 2).

While four cameras 218 are depicted arranged at the upper end 212*a* of the tool 208, more or less than four may be included in the tool 208 at the upper and/or lower ends 212*a,b*. Cameras 218 may also be mounted to the beams 216 at the lower end 212*b* (FIG. 2) of the tool 208. The cameras 218 may be mounted to the beams 216 axially above the upper end 222*a* (FIG. 2) of the impression sleeve 220, and axially below the lower end 222*b* of the impression sleeve 220, as mentioned above. This may prove advantageous in allowing the cameras 218 to capture images and/or video without being obstructed by portions of the impression sleeve 220.

Figure 4A:
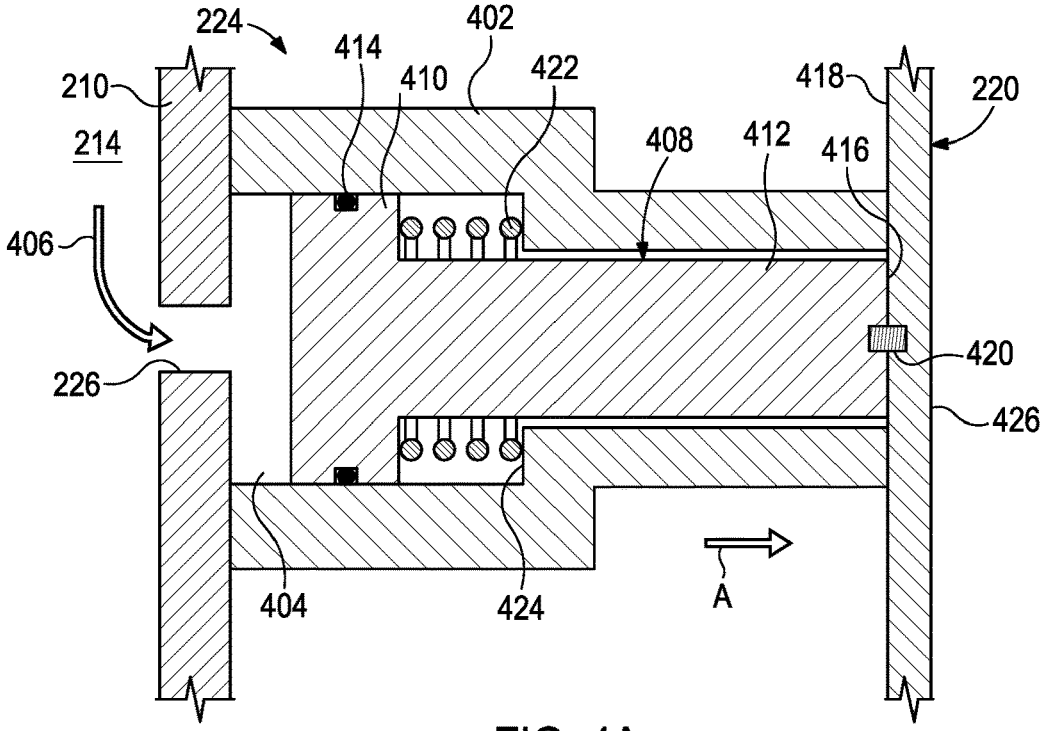
FIGS. 4A and 4B are schematic, cross-sectional side views of an example hydraulic assembly, according to one or more embodiments.
Figure 4B:
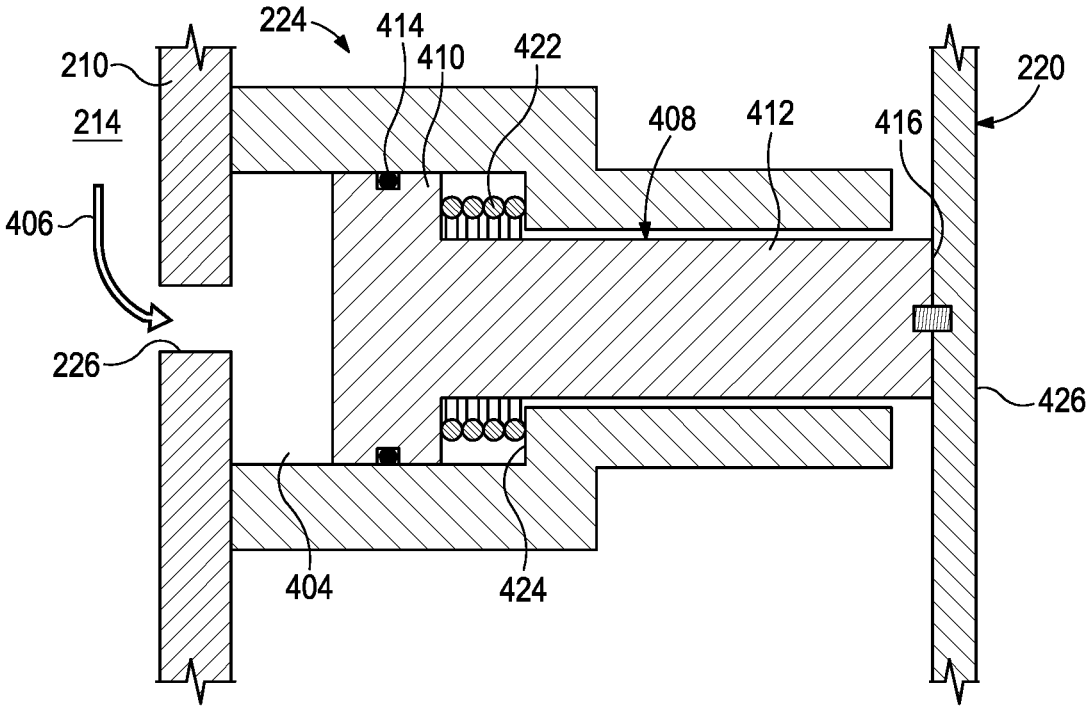

FIGS. 4A and 4B are schematic, cross-sectional side views of an example hydraulic assembly 224, according to one or more embodiments. FIGS. 4A-4B also depict example operation of the hydraulic assembly 224. Referring first to FIG. 4A, as illustrated, the hydraulic assembly 224 includes a cylindrical housing 402 that may be operatively coupled (either directly or indirectly) to the outer surface of the central body 210 and extend laterally therefrom. The cylindrical housing 402 may be operatively coupled to the central body 210 using any known means of fastening or coupling; e.g., mechanical fasteners, mechanical interconnection, welding, brazing, or any combination thereof.

The housing 402 may be secured to the central body at one of the ports 226, which places the housing 402 in fluid communication with the inner chamber 214 of the central body 210. More specifically, the cylindrical housing 402 may define a hydraulic fluid chamber 404 that fluidly communicates with the inner chamber 214 via the port 226, such that hydraulic fluid 406 conveyed within the inner chamber 214 is able to flow into the hydraulic fluid chamber 404 via the port 226 and actuate (operate) the hydraulic assembly 224. The hydraulic fluid 406 may comprise, for example, water, oil, or another non-compressible fluid.

The hydraulic assembly 224 may further include a piston 408 movably arranged within the hydraulic fluid chamber 404. The piston 408 includes a piston head 410 and a piston rod 412 extending from the piston head 410. In some embodiments, the piston head 410 and piston rod 412 may comprise a monolithic, single-piece structure. In other embodiments, however, the piston head 410 and the piston rod 412 may comprise separate component parts that are operatively coupled together to cooperatively form the piston 408. In such embodiments, the piston head 410 may comprise a flat, cylindrical body mechanically attached to the piston rod 412, such as via a threaded interface, a mechanical fastener, welding, or any combination thereof.

The hydraulic assembly 224 may further include one or more seals 414 (one shown) arranged to seal the interface between the piston head 410 and an inner wall of the hydraulic fluid chamber 404. The seal 414 may be made of any resilient material capable of creating a sealed interface between the piston head 410 and the inner wall of the hydraulic fluid chamber 404. In some embodiments, for example, the seal 414 may comprise an O-ring or the like.

A distal end 416 of the piston rod 412 may be arranged to engage an inner surface 418 of the impression sleeve 220. In some embodiments, the piston rod 412 may be secured to the impression sleeve 220 at the distal end 416. In such embodiments, the piston rod 412 may be secured to the impression sleeve 220 using any known means of fastening or coupling; e.g., mechanical fasteners, mechanical interconnection, welding, brazing, or any combination thereof. In at least one embodiment, the piston rod 412 may be threaded to the impression sleeve 220 at a threaded interface 420. Moreover, in such embodiments, the piston assembly 224 may help support the impression sleeve 220 (e.g., the sleeve segments 302*a-d* of FIG. 3) in the tool 208 (FIGS. 1-3). In other embodiments, however, the distal end 416 of the piston rod 412 may be merely engageable with the inner surface 418 of the impression sleeve 220, without departing from the scope of the disclosure.

The hydraulic assembly 224 may further include a biasing device or spring 422 arranged between the piston head 410 and a radial shoulder 424 defined by the hydraulic fluid chamber 404. The spring 422 may provide a constant force that urges the piston head 410 away from the radial shoulder 424.

With reference to FIGS. 4A and 4B, example operation of the hydraulic assembly 224 is now provided. When it is desired to actuate (operate) the hydraulic assembly(ies) 224, hydraulic fluid 406 is introduced into the inner chamber 214 of the central body 210, and the hydraulic fluid 406 is able to enter (migrate into) the hydraulic fluid chamber 404 via the port 226. Hydraulic fluid 406 entering into the hydraulic fluid chamber 404 acts on the piston head 410 and causes the piston 408 to actuate or move between a first position, as shown in FIG. 4A, and a second position, as shown in FIG. 4B. In the first position, the piston rod 412 is retracted within the piston chamber 404 such that the impression sleeve 220 lies flush with the distal end of the cylindrical housing 402.

As the hydraulic fluid 406 enters the hydraulic fluid chamber 404 via the port 226, it acts on the piston head 410 and causes the piston 408 to radially extend and otherwise move radially outward to the second position, as shown in FIG. 4B. The seal 414 sealed interface between the piston head and the inner wall of the hydraulic fluid chamber as the piston 408 moves to the second position. Moreover, as the piston 408 moves from the first position to the second position, the spring 422 is compressed between the piston head 410 and the radial shoulder 424 and builds spring force that can be released once the hydraulic pressure against the piston head 410 is removed.

The piston 408 is urged radially outward so that the malleable material of the impression sleeve 220 is forcefully pressed against the inner surface of the bowl 134 (FIGS. 1-2) of the tubing head spool 104 (FIGS. 1-2). Sufficient pressing force applied by the hydraulic assembly 224 deforms the impression sleeve 220 and creates an impression (plastic deformation) on the outer surface 426 of the impression sleeve 220. The impression sleeve 220 is substantially aligned with the area of the bowl 134, including the load shoulder 128 (FIGS. 1-2) such that the impression taken is of the entire area of the bowl 134.

Once the physical impression is taken on the impression sleeve 220, hydraulic pressure within the fluid chamber 404 and the inner chamber 214 may be reduced, thereby allowing the potential energy stored in the spring 422 to return the piston 408 back to the first position. Moreover, because the distal and 416 of the piston rod 412 is secured to the impression sleeve 220, expanding the spring 422 and thereby drawing the piston 408 back into the fluid chamber 404 will also draw the impression sleeve 220 away from the inner walls of the bowl 134 (FIGS. 1-2). This may prove advantageous in allowing the impression tool 220 to be removed from the tubing head spool 104 (FIGS. 1-2) without being obstructed by any features of the bowl 134, and without affecting the quality of the impression on the outer surface 426 of the impression sleeve 220.

Referring again to FIGS. 1 and 2, accordingly, the wellhead impression tool 208 may be used when a rig is on location and it will be run through blowout preventer (BOP) equipment and landed in the tubing head spool 104 adjacent the bowl 134. The following method may be pursued to use the wellhead impression tool 208 to evaluate the bowl 134. The rig will retrieve the existing tubing hanger and completion and will commence their operation. After all operations are completed, the rig will run with a wellhead wash tool to clean the bowl 134. The rig will pick up the wellhead impression tool 208 and run it to the required depth within the tubing head spool 104. The rig will use the cameras 218 mounted to the tool 208 to observe the condition of the bowl 134 while running and while retrieving the tool 208.

Once the tool 208 is at the required depth within the tubing head spool 104, hydraulic pressure will be applied through the conveyance lowering the tool 208, which will cause the hydraulic assembly(ies) 224 to actuate and radially expand the impression sleeve 220. The impression sleeve 220 may be made of a malleable material having a low yield strength, and the bowl 134 will have a much higher yield strength, and thus will not be damaged by the activation or retraction of the impression sleeve 220. As the impression sleeve 220 is forced to radially expand, a physical impression of the bowl 134 will be obtained on the outer surface of the impression sleeve 220. Moreover, in some applications, the impression sleeve 220 may be made of multiple sleeve segments 302*a*-*d* (FIG. 3), which will facilitate the replacement of the impression sleeve 220 after each installation.

Once the impression is obtained, the hydraulic pressure may be reduced or bled to zero, which allows the hydraulic assembly(ies) 224 to retract. The tool 280 can then be retrieved at that stage, and the well operator will inspect each segment of the impression sleeve 220 and review the images captured by the cameras 218 to evaluate the condition of the tubing head spool 104.

The tool 208 has a simple installation and retrieval method since it can utilize drill pipe as a conveyance, which is always available on drilling rigs. Moreover, the tool 208 can be activated by hydraulic pressure where the rig pumps a hydraulic fluid through the drill pipe to activate the impression sleeve 220. The BOP is not removed while running and retrieving the wellhead impression tool 208, which will enhance safety since the BOP can be used in case of emergencies.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellhead impression tool, comprising:

an elongate central body having opposing upper and lower ends, and defining an inner chamber;

an impression sleeve arranged concentric with the central body and made of a malleable material, the impression sleeve comprising a plurality of arcuate sleeve segments; and a hydraulic assembly extending between the impression sleeve and the central body and in fluid communication with the inner chamber to receive a hydraulic fluid from the inner chamber, the hydraulic assembly comprising a plurality of hydraulic assemblies, wherein the hydraulic assembly is operable to force the impression sleeve radially outward and into engagement with a bowl of a wellhead spool of a wellhead assembly, wherein forcing the impression sleeve against the bowl results in a physical impression of the bowl on an outer surface of the impression sleeve, and wherein a corresponding one of the plurality of hydraulic assemblies extends between each arcuate sleeve segment and the central body.

2. The wellhead impression tool of claim 1, further comprising:

one or more beams coupled to and extending laterally from the central body;

at least one camera mounted to the one or more beams and operable to capture images and/or video of the bowl as the wellhead impression tool advances into or out of the wellhead spool.

3. The wellhead impression tool of claim 2, wherein the one or more beams comprise:

a first plurality of beams extending radially outward from the central body at or near the upper end; and a second plurality of beams extending radially outward from the central body at or near the lower end, wherein the at least one camera is mounted to first and second plurality of beams above or below the impression sleeve such that the impression sleeve does not obstruct a view of the at least one camera.

4. The wellhead impression tool of claim 1, wherein the malleable material comprises lead.

5. The wellhead impression tool of claim 1, wherein each hydraulic assembly is independently operable to force a corresponding one of the plurality of arcuate sleeve segments radially outward and into contact with the bowl.

6. The wellhead impression tool of claim 1, wherein the hydraulic assembly comprises:

a cylindrical housing operatively coupled to the central body and defining a hydraulic fluid chamber in fluid communication with the inner chamber via a port defined in the central body; and a piston movably arranged within the hydraulic fluid chamber and attached to an inner surface of the impression sleeve;

wherein the hydraulic fluid entering the hydraulic fluid chamber from the inner chamber actuates the piston between a first position, where the piston is retracted within the piston chamber, and a second position, where the piston is radially extended and forces the impression sleeve against the bowl to obtain the physical impression.

7. The wellhead impression tool of claim 6, wherein the hydraulic assembly further comprises a spring arranged in the hydraulic fluid chamber and providing a constant force that urges the piston to the first position.

8. The wellhead impression tool of claim 1, wherein the hydraulic assembly couples the elongate central body to the impression sleeve.

9. The wellhead impression tool of claim 1, wherein the hydraulic assembly extends radially between the elongate central body and the impression sleeve.

10. A method for operating a wellhead impression tool, comprising:

advancing the wellhead impression tool into a through bore of a wellhead spool of a wellhead assembly, the through bore defining a bowl and the wellhead impression tool including:

an elongate central body having opposing upper and lower ends, and defining an inner chamber;

an impression sleeve arranged concentric with the central body and made of a malleable material; and a hydraulic assembly extending between the impression sleeve and the central body and in fluid communication with the inner chamber;

conveying a hydraulic fluid to the hydraulic assembly from the inner chamber;

forcing the impression sleeve radially outward with the hydraulic assembly and into engagement with the bowl; and obtaining a physical impression of the bowl on an outer surface of the impression sleeve.

11. The method of claim 10, further comprising:

reducing a pressure of the hydraulic fluid and thereby allowing the impression sleeve to radially retract away from the bowl; and removing the wellhead impression tool from the wellhead spool.

12. The method of claim 11, wherein the wellhead impression tool further includes one or more beams coupled to and extending laterally from the central body, and at least one camera mounted to the one or more beams, the method further comprising:

capturing images and/or video of the bowl with the at least one camera as the wellhead impression tool advances into and out of the wellhead spool.

13. The method of claim 10, wherein advancing the wellhead impression tool into the through bore of the wellhead spool comprises:

connecting the upper end of the central body to a conveyance suspended on a rig; and advancing the conveyance downward and thereby advancing the wellhead impression tool into the wellhead spool.

14. The method of claim 10, wherein the impression sleeve comprises a plurality of arcuate sleeve segments, and the hydraulic assembly comprises a plurality of hydraulic assemblies, and a corresponding one of the plurality of hydraulic assemblies extends between each arcuate sleeve segment and the central body, and wherein forcing the impression sleeve radially outward with the hydraulic assembly comprises:

conveying the hydraulic fluid to each hydraulic assembly from the inner chamber; and forcing each arcuate sleeve segment radially outward and into engagement with the bowl with a corresponding one of the plurality of hydraulic assemblies.

15. The method of claim 10, wherein the hydraulic assembly includes a cylindrical housing coupled to the central body and defining a hydraulic fluid chamber in fluid communication with the inner chamber via a port defined in the central body, and a piston movably arranged within the hydraulic fluid chamber and attached to an inner surface of the impression sleeve, and wherein conveying the hydraulic fluid to the hydraulic assembly comprises forcing the piston radially outward with the hydraulic fluid and thereby forcing the impression sleeve against the bowl to obtain the physical impression.

16. The method of claim 15, wherein the hydraulic assembly further includes a spring arranged within hydraulic fluid chamber, the method further comprising urging the piston radially inward with the spring.

* * * * *